United States Patent [19]

Watermann et al.

[11] Patent Number: 4,773,795

[45] Date of Patent: Sep. 27, 1988

[54] ROOF CAP ASSEMBLY WITH SUPPORTING CYLINDERS FOR ROOF SUPPORT MECHANISM

[75] Inventors: Willy Watermann, Dortmund; Heinz-Gerd Schlutz, Marl, both of Fed. Rep. of Germany

[73] Assignee: Klöckner-Becorit GmbH, Castrop-Rauxel, Fed. Rep. of Germany

[21] Appl. No.: 82,553

[22] Filed: Aug. 7, 1987

[30] Foreign Application Priority Data

Aug. 8, 1986 [DE] Fed. Rep. of Germany ..... 3626951
Aug. 8, 1986 [DE] Fed. Rep. of Germany ..... 362950

[51] Int. Cl.[4] ..... E21D 17/054; E21D 17/086

[52] U.S. Cl. ..... 405/293; 405/291; 405/295

[58] Field of Search ..... 405/291–296, 405/302; 299/31, 33; 91/170 MP

[56] References Cited

U.S. PATENT DOCUMENTS 3,097,829 7/1963 Seddon ..... 405/293
3,333,425 8/1967 Hemard ..... 405/293
4,293,246 10/1981 Boer et al. ..... 405/291
4,447,174 5/1984 Becker et al. ..... 405/293
4,465,408 8/1984 Krieger et al. ..... 405/302

FOREIGN PATENT DOCUMENTS 3613765 5/1987 Fed. Rep. of Germany .
3540807 6/1987 Fed. Rep. of Germany .
1249412 10/1971 United Kingdom ..... 405/293

*Primary Examiner*—Dennis L. Taylor
*Attorney, Agent, or Firm*—Watson, Cole, Grindle & Watson

[57] ABSTRACT

A roof cap assembly of a roof support mechanism includes a main cap having extension bearing portions at its front end, a forward cap which is pivotally attached at its rear end to the extension bearing portions of the main cap, and two supporting cylinders connected between the main cap and the forward cap at spaced apart locations across their widths and so as not to extend therebelow. The supporting cylinders include a housing containing twin pistons and an adjustable pressure transmitter is provided for each supporting cylinder and is constructed to increase the pressure in the pressure chambers therein when the pressure of the pressure medium supplied thereto exceeds a minimum set value.

9 Claims, 2 Drawing Sheets

41
45
46

41
43
48
46
42a
41a
42

40
43
47
46
48
52
41
44
53
51
c
42
d
42
e
f
42b
42c 48
47
50
49
42
c

ROOF CAP ASSEMBLY WITH SUPPORTING CYLINDERS FOR ROOF SUPPORT MECHANISM

BACKGROUND OF THE INVENTION

1. FIELD OF THE INVENTION

The present invention relates to adjustable roof support mechanisms for supporting roofs of mines, and more particularly to the roof cap assemblies used in such roof support mechanisms.

2. THE PRIOR ART

Adjustable roof support mechanisms for supporting the roofs of mines are well known. Such roof support mechanisms can include a roof cap assembly, which includes a main cap, a forward cap that is pivotally connected to the forward end of the main cap in a cantilever fashion, the forward cap having a front tip for contacting the roof of the mine, and supporting cylinders that are connected between the main cap and the forward cap to control the orientation of the forward cap relative to the main cap; a breakage shield which is connected to the rear end of the main cap of the roof cap assembly; one or more foot elements which rest on the floor of the mine; a plurality of connecting arms which connect the rear end of the foot element(s) to the rear end of the breakage shield, and one or more extendable strut (prop) elements which extend upwardly from the foot element(s) to the main cap of the roof cap assembly. See, for example, U.S. Pat. No. 4,293,246, British Patent No. 1,249,412 and German Patent No. 36 13 765.

Known roof cap assemblies of such roof support mechanisms utilize supporting cylinders that include two pressure medium connections, one for supplying pressure medium to the cylinder chamber between the head of the piston and the end wall of the cylinder and the other for supplying pressure medium to the annulus between the piston rod and the side wall of the cylinder. Since these known supporting cylinders are operated with pressure mediums under normal pressures, the roof supporting mechanisms in which they are used must utilize at least three of them between the main cap and the forward cap, i.e., in spaced apart relationship across their widths, so that the front tip of the forward cap can be set against the mine roof with the necessary force. However, the areas occupied by the supporting cylinders cannot be used by other components, such as control elements.

The object of the present invention is to provide a supporting cylinder of the aforementioned kind which is constructed such that a roof cap assembly using such supporting cylinders needs only two of them, at spaced locations across the widths of the main cap and the forward cap, yet can assure the necessary force applied by the front tip of the forward cap against the mine roof.

SUMMARY OF THE INVENTION

According to the present invention the supporting cylinders are constructed such that they can exert a high expansion force, and pressure transmitters are utilized for each supporting cylinder, each pressure transmitter being constructed to increase the expansion force of the associated supporting cylinder when a minimum set value of pressure of the pressure medium supplied thereto is exceeded. Since the supporting cylinders can exert very high expansion forces, they can provide the forward cap to which they are attached with a high pivoting force, thus enabling the front tip of the forward cap to contact the roof of a mine with correspondingly high force. In addition to this, a comparatively small lever arm between the forward cap joint and the attachment point of the supporting cylinder to the main cap is sufficient to set and lock the forward cap into position. Thus the result is that the main cap sits comparatively low and no parts of the supporting cylinder project downwardly below the main cap or the forward cap.

The supporting cylinder can be constructed as a group of supporting cylinders. Thus a single cylinder housing can be used to house several pistons and piston rods. Each group of supporting cylinders can be associated with a pressurecontrolled pressure transmitter so that only one pressure transmitter is sufficient for several pistons and piston rods.

The pressure transmitter can be located within the cylinder housing so as to provide a compact unit comprising a cylinder housing, piston with piston rods and transmitter. It is also possible to design the pressure transmitter as separate function elements located outside the cylinder housing. This is especially advantageous where there is insufficient space for the entire unit comprising cylinder housing, piston, and pressure transmitter.

In a preferred embodiment of the invention, the pressure transmitter comprises an adjustable, hydraulically actuated control valve, a control piston interacting with the control valve, a differential piston, and a non-return valve.

The valves and the pressure transmitter are suitably adjusted such that, starting from a pressure which is slightly below a set pressure, the differential piston is actuated, the control valve opens and the non-return valve closes.

Another feature of the invention envisions that the supporting cylinder in the main cap is connected to the main cap at a distance from its front end and to the rear end of the forward cap, and on the front end of the main cap a bearing groove is provided, the groove being upwardly open and constricted at its mouth. On the rear end of the forward cap is a fitting pivot pin with a narrow portion which can pass through the constriction. The result is a roof cap assembly of an adjustable roof support mechanism in which the main cap and the forward cap can easily attached together and thereafter aligned. In addition to this, the supporting cylinders do not require any additional space below the forward cap joint so that no parts thereof project downwardly below the bottoms of the main cap or the forward cap.

On the front end of the main cap bearing extensions with bearing formations with one constriction each are suitably provided.

Furthermore, recesses, which are crossed by pivot pins, can be provided on the rear end of the forward cap.

In another embodiment of the invention the narrow portion of the pivot pin can include opposite flat surfaces that are inclined at an acute angle with respect to the longitudinal direction of the forward cap.

The invention will now be better understood by reference to the attached drawings.

DETAILED DESCRIPTION OF THE PREFERRED EMBODIMENT

Figure 1:
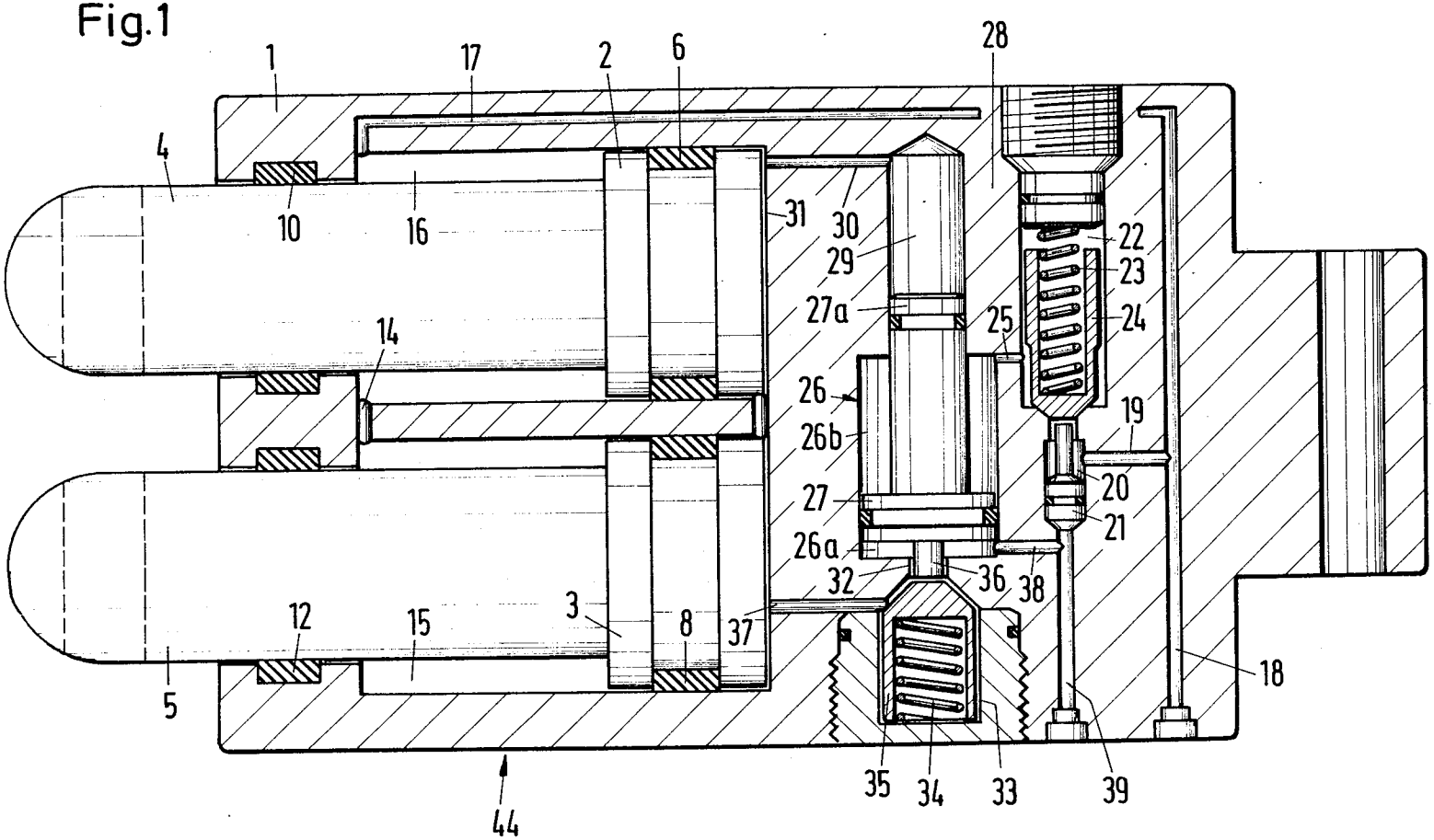
FIG. 1 shows a cross-sectional view through a supporting cylinder which is constructed in accordance with a preferred embodiment of the present invention.

The inventive supporting cylinder illustrated in FIG. 1, comprises a housing 1 having a floor portion 28 and two pistons 2, 3 having piston rods 4, 5 which are movable in the housing. The pistons 2, 3 and the piston rods 4, 5 are sealed with respect to the housing by means of seals 6, 8, 10, 12. Bores 17, 18 lead away from the two annuluses 15, 16 formed between the piston rods 4, 5 and the housing 1, these annuluses being connected by a cross connection 14. The bore 18 is connected to a cylinder chamber 20 via another bore 19. A control piston 21 is movably positioned in the cylinder chamber 20. The cylinder chamber 20 is in turn connected to another cylinder chamber 22 in which a valve member 24, driven by a spring 23, is provided, the valve member 24 and the spring 23 forming an adjustable control valve. A cross bore 25 leads from the cylinder chamber 22 to another cylinder chamber 26, which contains a differential piston 27 that includes a piston rod 27*a*. The differential piston 27 divides the cylinder chamber 26 into a piston chamber 26a and an annulus 26b. Within the floor 28 of the housing 1 two bores 29, 30 lead from the cylinder chamber 26 to the cylinder chamber 31 formed between the floor 28 and the pistons 2, 3.

Furthermore, a bore 32 leads from the cylinder chamber 26 to a chamber 33 in which there is a valve member 35, driven by a spring 34. The valve member 35 is actuated via a ram 36 of the differential piston 27. Another bore 37 leads from the chamber 33 into the cylinder chamber 31 formed between the floor 28 and the pistons 2, 3. In addition to this, bores 38 and 39 lead outwardly from the cylinder chamber 26.

When supplying an operating medium that is under pressure to the bore 39, the non-return valve 34, 35 is open and the adjustable control valve 23, 24 is closed. The differential piston 27 is not actuated. The pressure medium flows through the bores 39 and 38, the cylinder chamber 26, the bore 32, the cylinder chamber 33 and the bore 37 into the piston chamber 31, thus moving the piston rods 4, 5 outwardly of the housing 1. The pressure medium, which is consequently forced out of the annuluses 15, 16, flows through the bores 17 and 18 and away from the housing.

The individual valves are adjusted in the illustrated preferred embodiment in such a manner that at a pressure of more than 230 bar, the differential piston 27 is put into action, the adjustable control valve 23, 24 opens, and the non-return valve 34, 35 closes. In this switched state, the pressure medium in the annulus 26 can flow outwardly through the bore 25 through the control valve 23, 24, the cylinder chamber 20, the bore 19, and the bore 18. Thus the differential piston 27 and the piston rod 27*a* will move upwardly as seen in FIG. 2, thus inducing a substantial increase in the pressure in piston chamber 31.

Figures 2, 3, 4, 5:
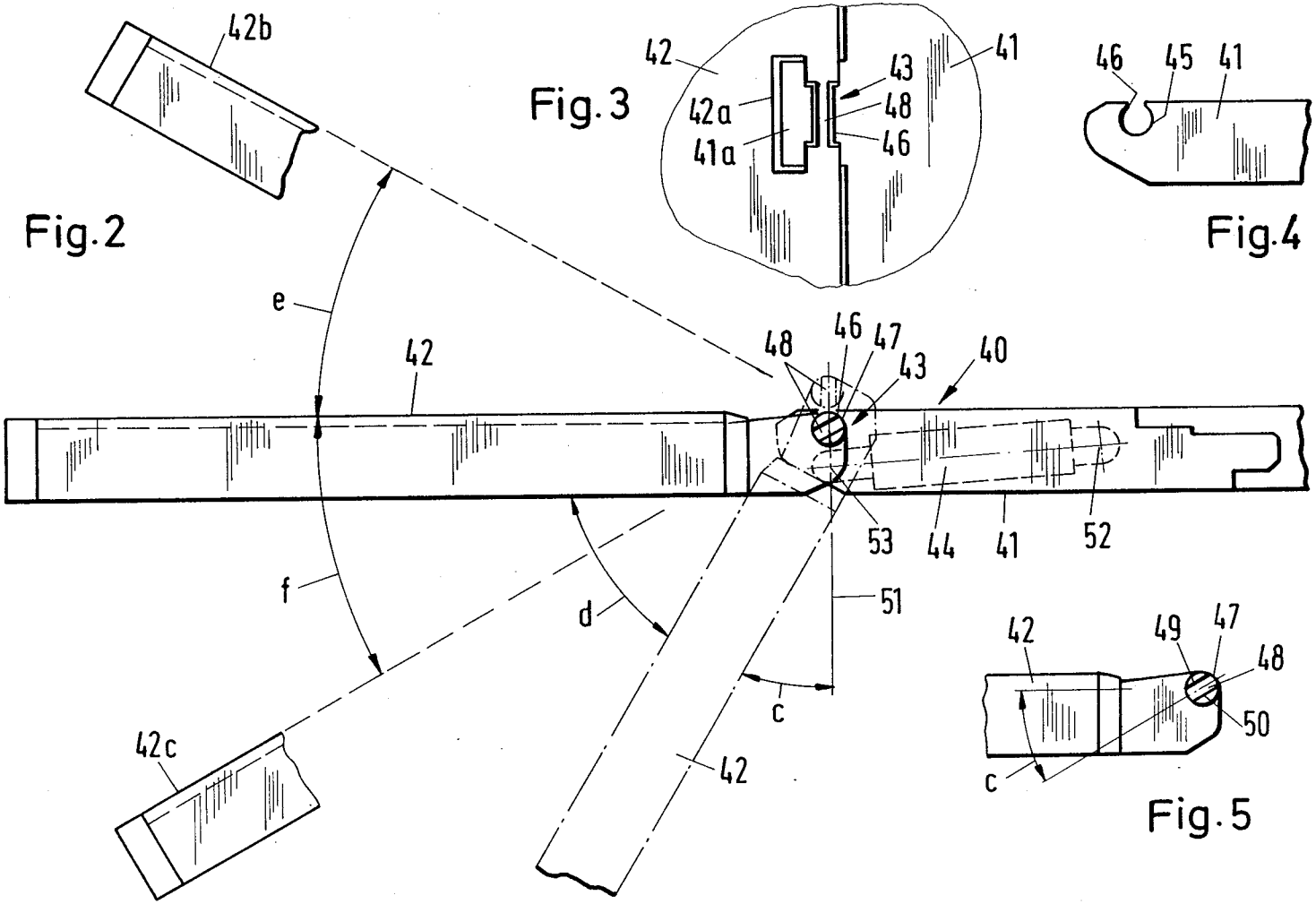
FIG. 2 shows a side view of a forward cap and the front end portion of the main cap of a roof cap assembly according to the present invention.
FIG. 3 shows a plan view of a detail of the roof cap assembly shown in FIG. 2.
FIG. 4 shows a side view of another detail of the roof cap assembly shown in FIG. 2.
FIG. 5 shows a side view of a further detail of the roof cap assembly shown in FIG. 2.

FIG. 2 shows a front portion of the roof bar assembly 40 of an adjustable roof support mechanism (note this front portion will be closest to the coat face being worked on in the mine), and FIGS. 3–5 show details thereof. The roof cap assembly 40 comprises a main cap 41 and a forward cap 42, the main cap 41 and the forward cap 42 being pivotally connected to one another via a joint 43. The joint 43 is bridged via supporting cylinders 44, which are pivotally attached at their opposite ends to the main cap 41 and the forward cap 42.

As indicated in FIG. 2, in their conventional operating positions the main cap 41 and forward cap 42 are aligned in a common plane.

The joint 43 is provided by suitable configurations of the front end of the main cap 41 and the rear end of the forward cap 42. More specifically, as seen in FIG. 4 the front end of the main cap 41 includes two extension bearing portions 41*a* which each contain upwardly open grooves 45 that are constricted at their mouths 46. On the other hand, as seen in FIGS. 3 and 5 the rear end of the forward cap 52 includes two recesses 42*a* that are crossed by pins 47 each pin having a narrow portion 48 that includes parallel flat surfaces 49 and 50 that are inclined at an angle C of about 30° relative to the longitudinal dimension of the forward cap 42.

FIG. 2 also illustrates how the forward cap 42 is attached to the main cap 41. The orientation of the forward cap 42 when it is to be attached to the main cap 41 is indicated by a dot-dash line. In this connection orientation, the forward cap 42 is inclined at an angle d (about 60°) with respect to the forward cap 42 when aligned with the main cap 41, and by the angle c (about 30°) with respect to a perpendicular line 51. During connection, the forward cap 42 is lowered downwardly so that the narrow portions 48 of the pins 47 are guided through the mouths 46 of the grooves 45 in the extension housing portions 41a of the main cap 41. Then the forward cap 42 is pivoted upwardly into a use position. As the forward cap 42 is rotated into its use position, the narrow portions 48 can no longer be moved upwardly and out of the grooves 45, i.e., due to the constricted mouths 46.

In the illustrated embodiment the forward cap 42 is pivotable through an arc about 60°, i.e., through an upward pivot arc e of about 30° and through a downward pivot arc f of about 30°. The positions of the forward cap at these extreme arc angles is depicted by reference numerals 42*b* and 42*c*.

The supporting cylinders 44 are connected to the main cap 41 at joints 52 and to the rear end of the forward cap at joints 53. The joints 52 are located at a distance of half the height of the main cap and the joints 52 below the joint 43, such that no portions of the supporting cylinders project downardly below the bottoms of the main cap 41 or the forward cap 42.

We claim:

1. A roof cap assembly of a roof support mechanism which includes a main cap having a forward end; a forward cap having a rear end, the rear end of the forward cap being pivotally attached to the front end of the main cap at a joint; two supporting cylinders pivotally connected at their respective opposite ends to said main cap and said forward cap at spaced apart locations along the widths of the main cap and the forward cap, said supporting cylinders being connected to said forward cap below said joint, each of said supporting cylinders including a housing, a pressure medium intake connection, a pressure medium outlet connection, and at least one movable piston within said housing and defining a piston chamber therein, each piston having a piston rod which extends outwardly of said housing; and an adjustable pressure medium-controlled pressure transmitter operatively connected to each said supporting cylinder, each said pressure transmitter being constructed to increase the pressure in said piston chamber after the pressure of said pressure medium supplied thereto via said pressure medium inlet connection exceeds a minimum set value, thus causing the associated supporting cylinder to expand further and cause the forward cap to pivot upwardly with a greater force about said joint.

2. A roof cap assembly as defined in claim 1, wherein each of said supporting cylinders comprises multiple pistons in the housing thereof with piston rods which extend in parallel outwardly of said housing.

3. A roof cap assembly as defined in claim 2, wherein the housing of each of said supporting cylinders includes a floor portion, and wherein the pressure transmitter associated with each supporting cylinder is located in the floor portion of the housing thereof.

4. A roof cap assembly as defined in claim 3, wherein each pressure transmitter includes an adjustable, hydraulically actuated control valve, a control piston interacting with the control valve, a differential piston, and a non-return valve.

5. A roof cap assembly as defined in claim 4, wherein said adjustable control valve can be adjusted to said minimum set value, and when the pressure of said pressure medium supplied through said pressure medium intake connection exceeds said minimum set value, said differential piston moves within said floor portion, said control valve opens and said non-return valve closes.

6. A roof cap assembly as defined in claim 1, wherein said main cap includes at least one extension bearing portion at its front end, each extension bearing portion including an upwardly open groove which has a constricted mouth, and wherein said forward cap has at least one cooperable recess in its rear end and a pivot pin extending across each recess, each pivot pin having a narrow portion which is positionable in a respective groove of an extension bearing portion of said main cap so as to provide said joint.

7. A roof cap assembly as defined in claim 6, wherein one end of each supporting cylinder is connected to said forward cap at a point below said pivot pin and at its second end to said main cap rearwardly of said front end thereof such that no part of said support cylinders extends beneath said main cap or said forward cap.

8. A roof cap assembly as defined in claim 7, wherein said main cap includes two said extension bearings with upwardly open grooves therein, and wherein said forward cap includes two cooperable recesses with pivot pins extending thereacross.

9. A roof cap assembly as defined in claim 8, wherein the narrow portion of each said pivot pin has opposite flat sides that extend at an acute angle relative to the longitudinal dimension of said forward cap, such that said forward cap must be oriented at an angle relative to the longitudinal dimension of said main cap in order for the pivot pins to fit through the constricted mouths of the grooves in the extension bearing portions of said main cap in order to connect the forward cap to the main cap, and when said forward cap is thereafter pivoted into an operating position, said pivot pins will be locked in said grooves.

* * * * *